US009319771B2

(12) United States Patent
Yuen

(10) Patent No.: US 9,319,771 B2
(45) Date of Patent: Apr. 19, 2016

(54) EARPHONE

(75) Inventor: Shun Ming Yuen, Hong Kong (CN)

(73) Assignee: INNOVATION SOUND TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/131,687

(22) PCT Filed: Aug. 9, 2012

(86) PCT No.: PCT/CN2012/079898

§ 371 (c)(1),
(2), (4) Date: Jan. 9, 2014

(87) PCT Pub. No.: WO2014/023008

PCT Pub. Date: Feb. 13, 2014

(65) Prior Publication Data

US 2015/0319521 A1 Nov. 5, 2015

(51) Int. Cl.
*H04R 1/10* (2006.01)

(52) U.S. Cl.
CPC ..... *H04R 1/1058* (2013.01)

(58) Field of Classification Search
CPC ..... H04R 25/60; H04R 25/65; H04R 25/602; H04R 2225/31; H04R 2225/33; H04R 2460/17; H04R 2225/023; H04R 2225/025; H04R 2460/13; H04R 1/1016
USPC ..... 381/322–325, 328, 380
See application file for complete search history.

(56) References Cited

U.S. PATENT DOCUMENTS 3,819,860 A * 6/1974 Miller ..... H04B 1/40 381/380
4,375,016 A * 2/1983 Harada ..... H04R 25/656 381/380
7,634,099 B2 * 12/2009 Harvey ..... H04R 1/2819 381/380

FOREIGN PATENT DOCUMENTS

CN 101026904 A 8/2007
CN 101346010 A 1/2009
CN 201742539 U 2/2011
CN 202759569 U 2/2013

OTHER PUBLICATIONS

International Search Report of Appln. No. PCT/CN2012/079898 with English translation.

* cited by examiner

*Primary Examiner* — Suhan Ni
(74) *Attorney, Agent, or Firm* — Fitch, Even, Tabin and Flannery LLP

(57) ABSTRACT

The present invention relates to an earphone, which comprises a shell, a speaker arranged in said shell, an sound chamber corresponding to said speaker and an E&M, in which the sound emission hole is arranged in said E&M, and connected with said sound chamber; the earphone also comprises a normally closed pressure relief channel used for connecting the said sound chamber and the outside, and connected when a user puts said E&M in the ear canal.

10 Claims, 6 Drawing Sheets

EARPHONE

FIELD OF THE INVENTION

The present invention relates to a speaker, more specifically, an earphone.

BACKGROUND OF THE INVENTION

At present, most of in-ear earphones are moving coil earphone, and the principle is that the coil in the permanent magnetic field is connected with vibrating diaphragm, and drives the vibrating diaphragm to produce sound under signal current driving. The vibrating diaphragm in ordinary moving-coil earphone is relatively thin (for example, the thickness of PET/PEN/PE vibrating diaphragm is about 6.0~9.0 μm), so the vibrating diaphragm is easily deformed or permanently damaged due to impulsive force and impact of air pressure when a user wears earphone.

SUMMARY OF INVENTION

The technical problem to be solved by the present invention is to provide an improved earphone against above-mentioned disadvantages of relevant technologies.

The technical proposal taken to solve the technical problem by the present invention is to manufacture an earphone, comprising a shell, a speaker arranged in said shell, an sound chamber corresponding to said speaker and an "ear and mouth" earpiece (E&M), in which the sound emission hole is arranged in said E&M, and connected with said sound chamber; the earphone also comprises a normally closed pressure relief channel used for connecting the said sound chamber and the outside, and connected when a user puts said E&M in the ear canal.

The said earphone of the present invention, wherein said earphone comprises sound guiding apparatus and elastic element; said sound guiding apparatus is arranged on the side wall of said shell, and longitudinally moves back and forth between a stretch-out position and a draw-back position on the side wall of said shell; when said sound guiding apparatus is at the stretch-out position, said pressure relief channel is closed; when said sound guiding apparatus is at the draw-back position, said pressure relief channel is connected; said elastic element is arranged between said sound guiding apparatus and said shell to keep the said sound guiding apparatus maintain at the stretch-out position.

The said earphone of the present invention, wherein said speaker is arranged on the end of said sound guiding apparatus in the said shell, and used to define the said sound chamber together with such end; said E&M is arranged on the other end of said sound guiding apparatus outside the said shell. The sound guiding holes are arranged in said sound guiding apparatus, and connects said sound emission hole with said audio chamber;

The said earphone of the present invention, wherein the first vent hole is arranged on the side wall corresponding to said sound guiding apparatus and said sound chamber, and penetrated through the side wall of said sound guiding apparatus; when said sound guiding apparatus is at the stretch-out position, the external wall surface of such side wall of said sound guiding apparatus is close to the internal wall surface of said shell, and said first vent hole is blocked; when said sound guiding apparatus is at the draw-back position, a gap is arranged between external wall surface of such side wall of said sound guiding apparatus and internal wall surface of said shell, and said first vent hole is connected, and connects said sound chamber and said gap.

The said earphone of the present invention, wherein the second vent hole is arranged on the side wall of said shell, and connects said gap and the outside so as to connect said sound chamber and the outside; said first vent hole, gap and second vent hole constitute the said pressure relief channel.

The said earphone of the present invention, wherein said shell comprises the first shell and the second shell spliced with the first shell; said first shell comprises the first open end on which the ring-type inserting part inserted in the second shell is arranged; said second shell comprises the second open end inserted on said inserting part.

The said earphone of the present invention, wherein at least a limit slot is axially arranged on said inserting part, and alternately distributed on the circumference of said inserting part; at least a limit rib extending along axle direction is arranged on the internal wall surface of said second shell, and alternately distributed on the circumference of internal wall surface of said second shell, and located on at least a limit slot of said first shell respectively.

The said earphone of the present invention, wherein said second shell comprises the closed end opposite to said second open end, in which a through hole is arranged in the center of said closed end to provide a space for said sound guiding apparatus to pass through longitudinally; said sound guiding apparatus comprises the sound guiding component longitudinally passing through the said through hole and the sealing gasket fixed on the periphery of said sound guiding component; said sound guiding component comprises the cylindrical shell axially passing through the said through hole and the cover body installed on one end of said cylindrical shell; said cylindrical shell defines the sound guiding hole of sound guiding apparatus, and said cover body and speaker defines said sound chamber together.

The said earphone of the present invention, wherein the first punched hole is arranged at the center of said sealing gasket to provide a space for said cylindrical shell to pass through; the internal wall surface of said sealing gasket is stuck on the external wall surface of said cover body, and moves with said sound guiding component; the second punched hole is arranged on the side wall of said cover body, and the third punched hole is arranged on the side wall of said sealing gasket, and connected with the second punched hole to form the said first vent hole of said sound guiding apparatus.

The said earphone of the present invention, wherein the ring edge extending outward is arranged on the open end edge of said cover body, on which at least a notch extending radially is formed, and matched with at least a limit rib on the internal wall surface of said second shell respectively, which is used as the track for said cover body to move back and forth in said second shell.

The beneficial effects of the present invention: compared with relevant technologies, the pressure relief channel is set to connect sound chamber and the outside when a user puts said E&M in the ear canal so that the air pressure in sound chamber won't sharply increase with the admission of air in the ear canal, and vibrating diaphragm of the speaker won't be damaged with the increase of air pressure in the sound chamber 70.

DESCRIPTION OF THE DRAWINGS

The present invention is further described by combining the drawings and embodiments, wherein.

DETAILED DESCRIPTION OF THE PREFERRED EMBODIMENTS

Figure 1:
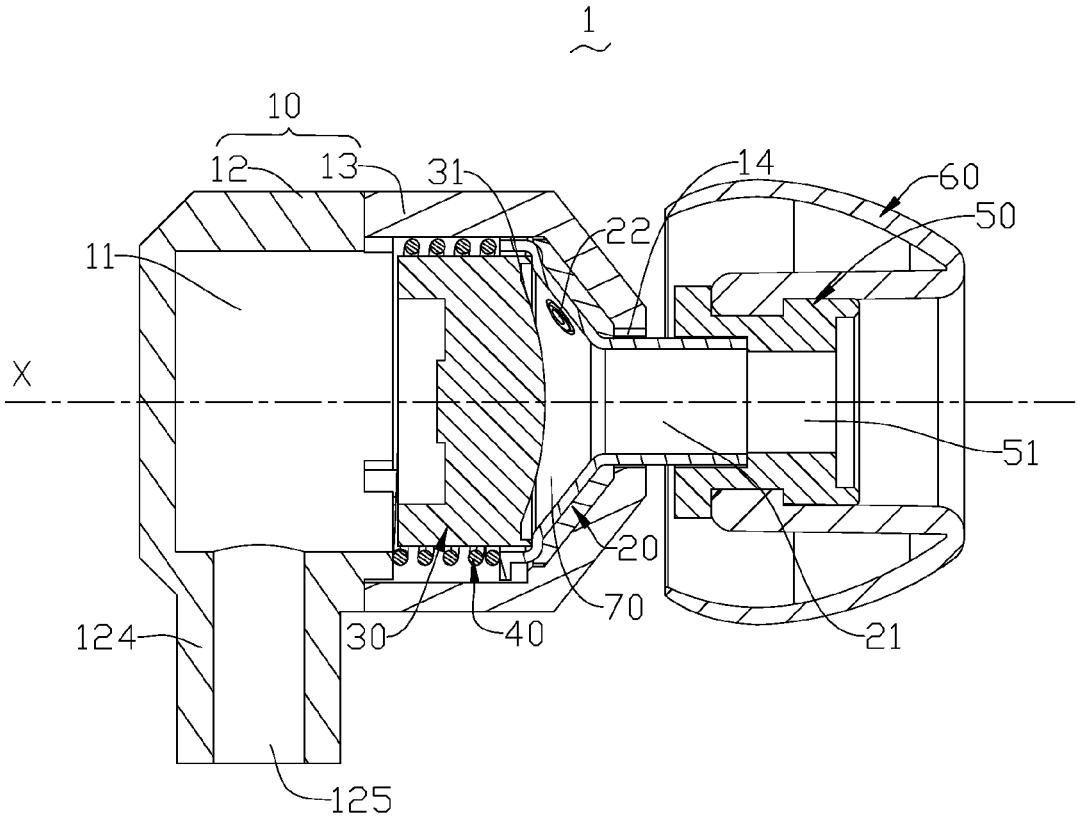
FIG. 1 is a longitudinal diagrammatic cross-section of earphone when the sound guiding apparatus is at the stretch-out position in some embodiments of the present invention.
Figure 2:
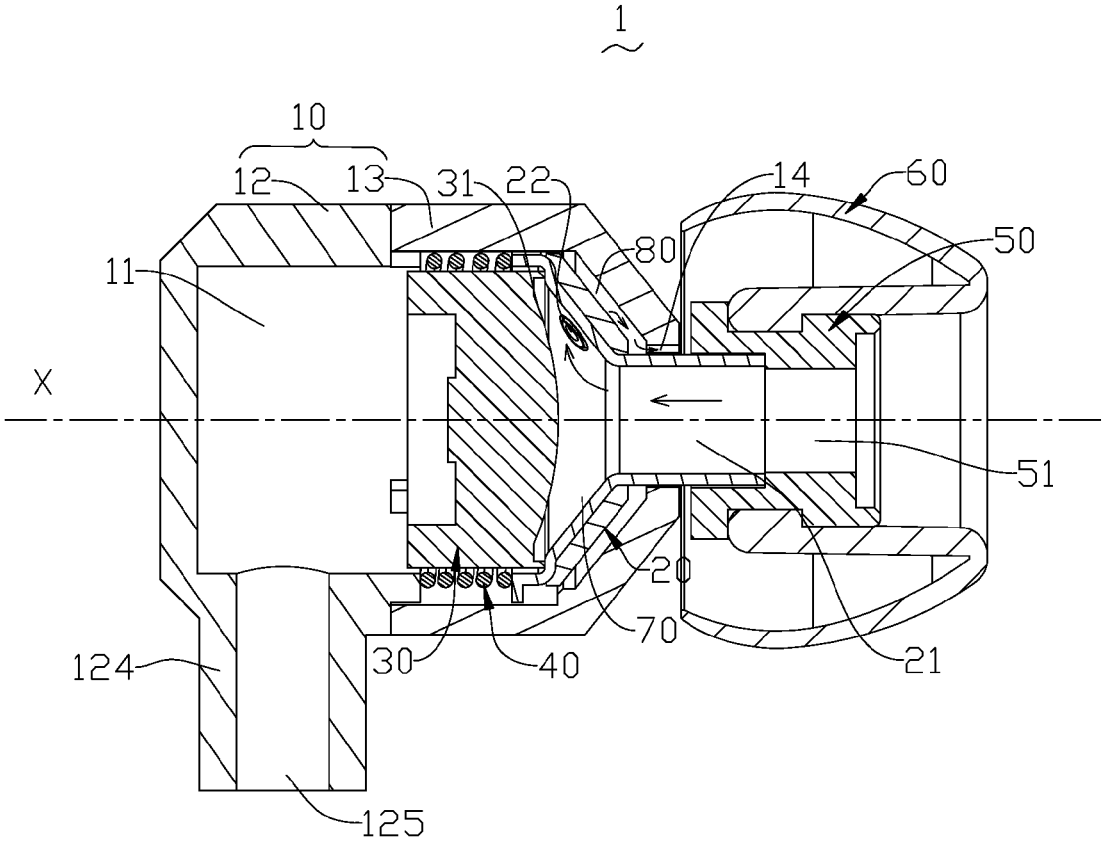
FIG. 2 is a longitudinal diagrammatic cross-section of the earphone as shown in FIG. 1 when the sound guiding apparatus is at the draw-back position.

The present invention is further described by combining embodiments and drawings, wherein:

FIG. 1 shows the earphone 1 in some embodiments of the present invention, which may comprise hollow shell 10, sound guiding apparatus 20, speaker 30, elastic element 40, E&M 50 and ear plug 60. The shell 10 defines a closed accommodating space 11 which is cylindrical in some embodiments, and has an axis X. Sound guiding apparatus 20 and accommodating space 11 are passing through the side wall of shell 11, and may move back and forth between a stretch-out position (as shown in FIG. 1) and a draw-back position (as shown in FIG. 2) on the side wall of shell 10 along axis X; there is a sound guiding hole 21 on the sound guiding apparatus 20. Speaker 30 and sound guiding apparatus 20 are coaxially arranged on the end of sound guiding apparatus 20 in accommodating space 11, and move back and forth with sound guiding apparatus 20; speaker 30 defines a closed sound chamber 70 with such end, and sound chamber 70 is over against vibrating diaphragm 31 of the speaker 30, and is connected with sound guiding apparatus 21. The elastic element 40 is set between sound guiding apparatus 20 and shell 10, and used to provide an appropriate elastic force for sound guiding apparatus 20. The elastic force, on one hand, is enough to keep the sound guiding apparatus 20 of the earphone 1 maintain at the stretch-out position under natural state, and on the other hand, is less than the friction force between ear plug 60 and ear canal of a user. E&M 50 is installed on the end of sound guiding apparatus 20 outside the shell 10, and has a sound emission hole 51 connected with sound guiding apparatus 20 as well as sound chamber 70 so that the sound made by speaker 30 is spread via sound emission hole 51. Ear plug 60 is connected with E&M 50 to improve the comfort when a user puts the earphone 1 in the ear.

Refer to FIG. 2: a vent hole 22 is set on the side wall corresponding to sound guiding apparatus 20 and sound chamber 70, and penetrated through the side wall. When sound guiding apparatus 20 is at the stretch-out position (as shown in FIG. 1), the external wall surface of such side wall is close to the internal wall surface of shell 10, and vent hole 22 is blocked; when sound guiding apparatus 20 is at the stretch-out position, a gap (as shown in FIG. 2) is arranged between external wall surface of such side wall and internal wall surface of shell 10, and vent hole 22 is connected, and connects sound chamber 70 and such gap 80. A vent hole 14 is set on the side wall of shell 10, and connects gap 80 and the outside so as to connect sound chamber 70 and the outside. Therefore, vent hole 22, gap 80 and vent hole 14 constitute a normally closed pressure relief channel (as indicated by arrows in FIG. 2), which is connected when sound guiding apparatus 20 is at the stretch-out position, and closed when sound guiding apparatus 20 is at the draw-back position. When a user puts the ear plug 60 of shell 10 of earphone 1 in the ear canal, the internal wall surface in the ear canal will, due to the effect of friction force, produce an opposite acting force transferred by ear plug 60 to E&M 50, sound guiding apparatus 20 and elastic element 40 in order. When such acting force is greater than the elastic force of elastic element 40, elastic element 40 will be compressed so that sound guiding apparatus 20 retracts toward shell 10, and said pressure relief channel is connected so as to connect sound chamber 70 and the outside, and the air pressure in sound chamber 70 won't sharply increase with the admission of air in the ear canal, and vibrating diaphragm 31 of the speaker 30 won't be damaged with the increase of air pressure in the sound chamber 70. After a user wears earphone, compressed elastic element 40 resets, and drives the shell 10 to keep away from the user, and sound guiding apparatus 20 recovers to the stretch-out position so as to close the said pressure relief channel, and reclose the sound chamber 70 to ensure the earphone 1 has a good tone quality. It can be understood that the number of said pressure relief channel is more than one.

Figure 3:
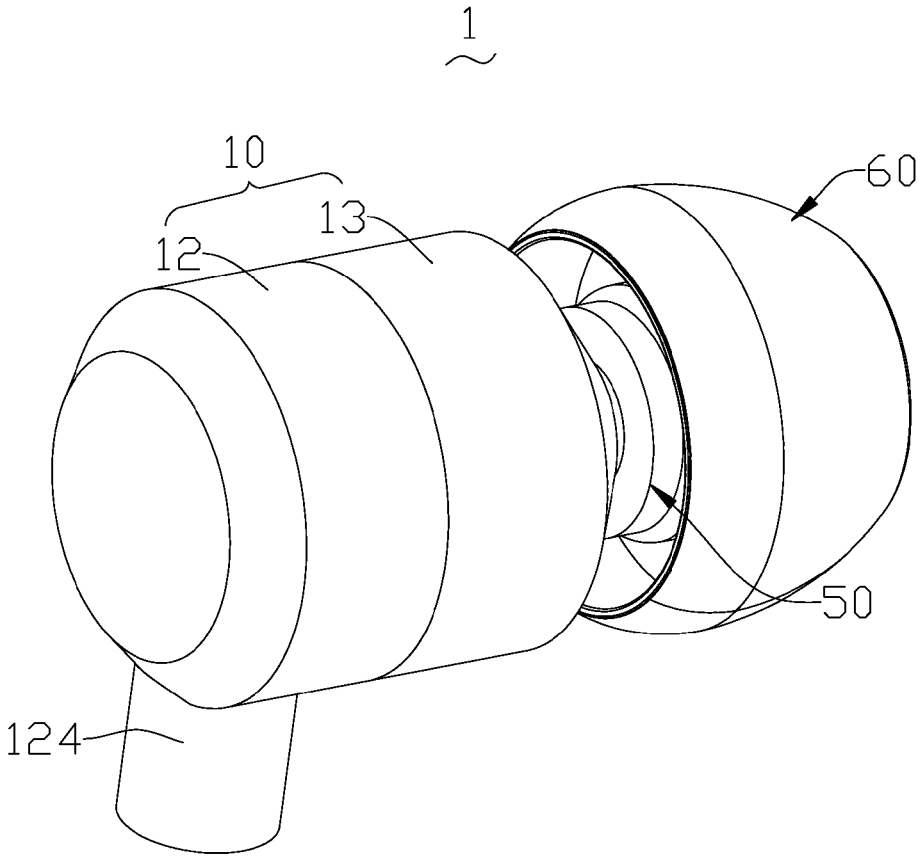
FIG. 3 is a 3D schematic diagram of the earphone as shown in FIG. 1.
Figure 4:
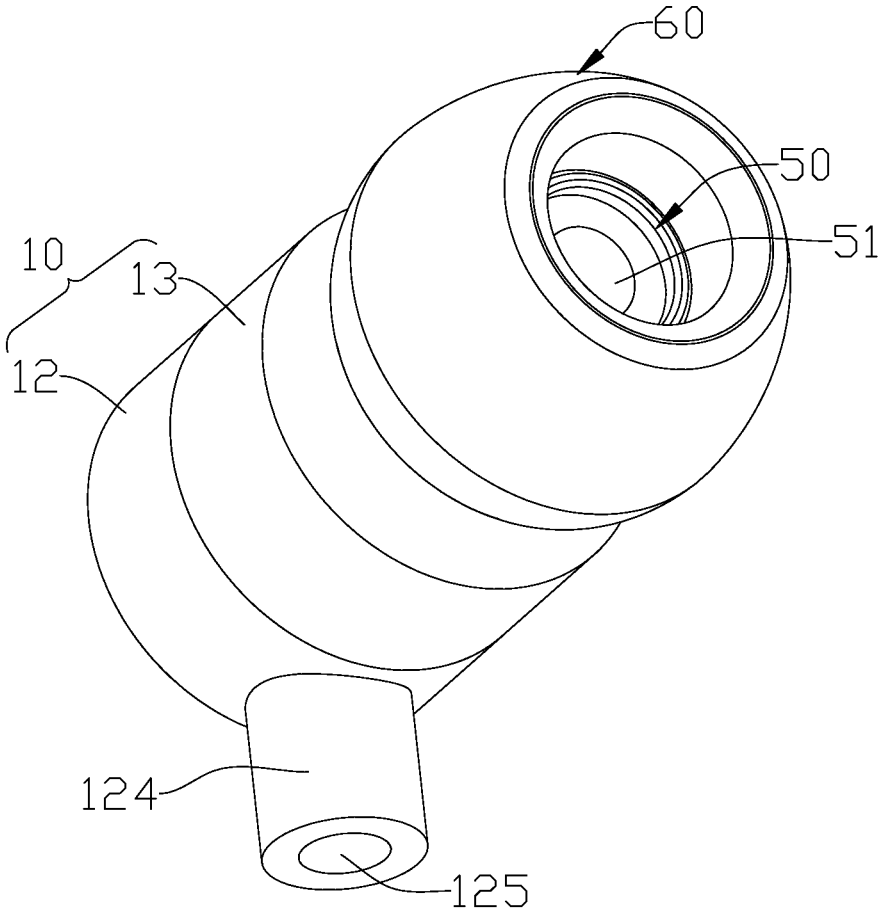
FIG. 4 is a 3D schematic diagram of the earphone as shown in FIG. 1 on other angle of view.
Figure 5:
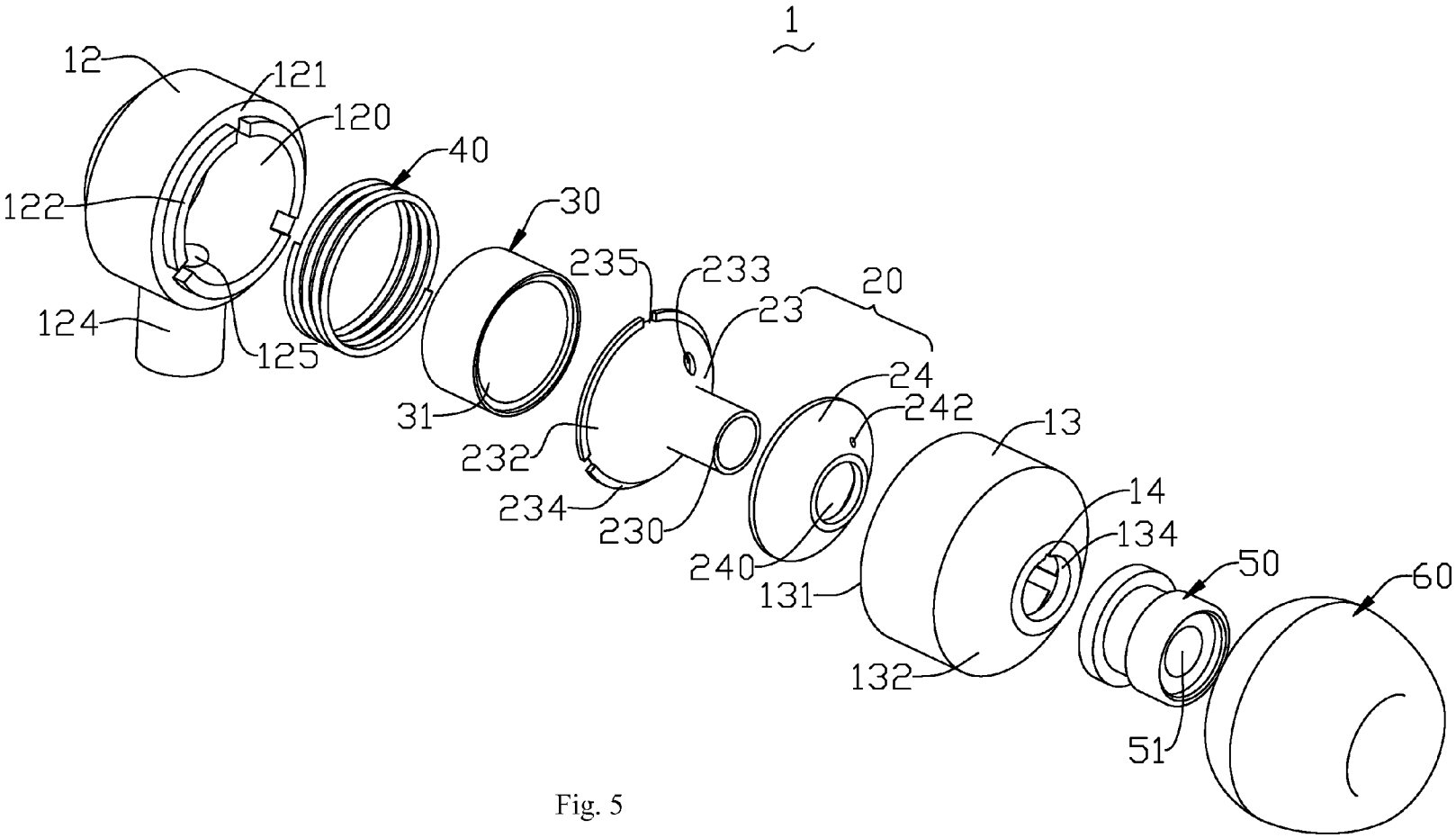
FIG. 5 is a 3D breakdown structure diagram of the earphone as shown in FIG. 1.

Refer to FIG. 3 to FIG. 5: the shell 10 may comprise the first shell 12 and the second shell 13 in some embodiments, wherein the first shell 12 is coaxially spliced with the second shell 13.

The first shell 12, in some embodiments, defines a cylindrical accommodating space 120 which is a part of said accommodating space 11, and shares the same axis with accommodating space 11. The first shell 12 comprises an open end 121, and is spliced on the second shell 13 via open end 121. A ring-type inserting part 122 inserted in the second shell 13 is set on the end of open end 121, and shares the same axis with accommodating space 120, and its outer diameter is less than that of open end 121. Several limit slots 123 are axially arranged on the inserting part 122, and alternately distributed on the circumference of inserting part 122, and matched with several limit ribs 133 in the second shell 13 to prevent the first shell 12 and the second shell 13 rotating around the axis X after splicing. The first shell 12 comprises a wire sheath 124 in some embodiments which is set on the side of first shell 12, and its axis is vertical to or intersects with axis X. Wire sheath 124 has a longitudinal wire hole 125 which is connected with accommodating space 120 of the shell 10 so that the conducting wire (not shown) can stretch in the accommodating space 11 via wire hole 125 to connect with the speaker 30.

Figure 6:
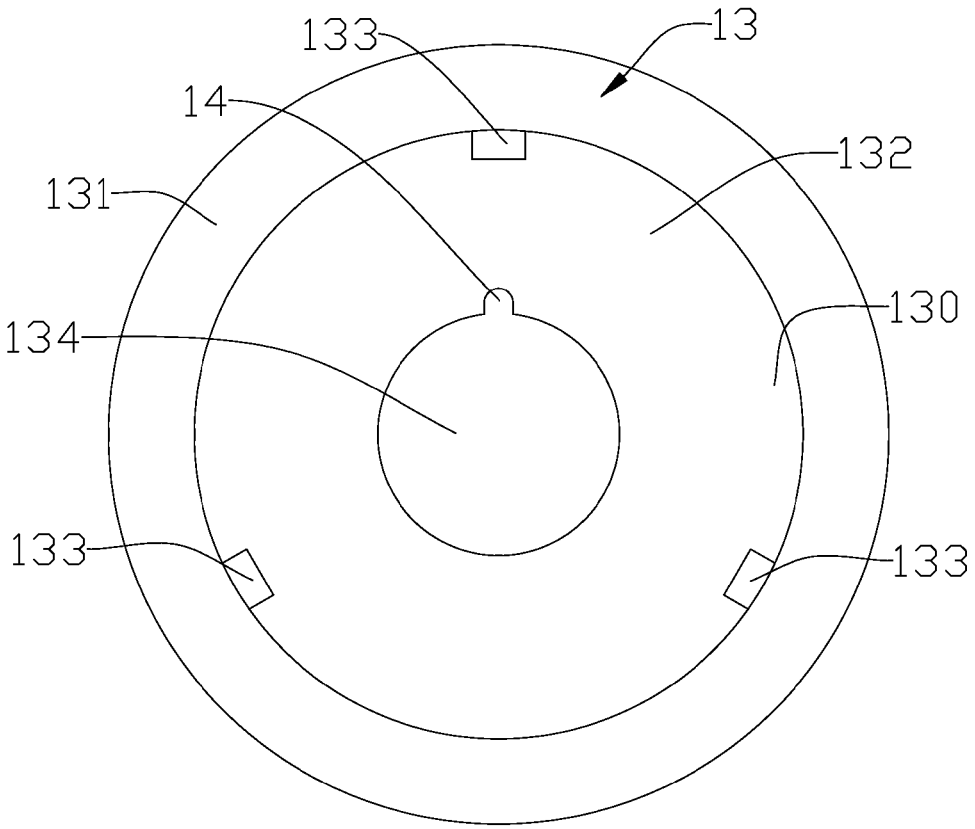
FIG. 6 is a lateral schematic diagram of second shell of the earphone as shown in FIG. 1.

Refer to FIG. 6: the second shell 13, in some embodiments, defines a cylindrical accommodating space 130 which constitutes another part of said accommodating space 11, and shares the same axis with accommodating space 11. Several limit ribs 133 extending axially are arranged on the side wall of accommodating space 130, and alternately distributed on the circumference of side wall surface of accommodating space 130. The second shell 13 comprises an open end 131 and a closed end 132 opposite to open end 131. The open end 131 is arranged on the inserting part 122 of first shell 12, and several limit ribs 133 are arranged inn several limit slots 123 on the inserting part 122 of first shell 12 respectively.

The closed end 132 is roughly conical in some embodiments (as shown in FIG. 1 and FIG. 2), and a vent hole 134 is arranged at the center of closed end 132 to provide a space for sound guiding apparatus 20 to pass through. The vent hole 14 is arranged at the closed end 132, and used to connect accommodating space 130 and the outside. The vent hole 14 is adjacent to the through hole 134 in some embodiments, and connects with through hole 134; when sound guiding apparatus 20 is close to the internal wall surface of closed end 132, the vent hole 14 can be blocked by the sealing gasket 24 of sound guiding apparatus 20.

As shown in FIG. 5, sound guiding apparatus 20 comprises the sound guiding component 23 passing through the through hole 134 of the second shell 13 and sealing gasket 24 fixed on the periphery of sound guiding component 23 in some embodiments. Sound guiding component 23 is made of metal materials in some embodiments, and is roughly funnel-shaped, and comprises the cylindrical shell 230 passing through the through hole 134 of the second shell 13 and cover body 232 coaxially fixed on one end of cylindrical shell 230, which the former defines the sound guiding hole 21 (as shown in FIG. 1) of sound guiding apparatus 20, and the latter is roughly conical, and defines said sound chamber 70 together with the speaker 30. Sealing gasket is roughly conical, and a punched hole 240 is arranged at the center of sealing gasket to provide a space for cylindrical shell 230 of sound guiding component 23 to pass through, and the internal wall surface of sealing gasket 24 is stuck on the external wall surface of cover body 232, and moves with sound guiding component 23. Sealing gasket 24, on one hand, can improve the sealing effect of sound guiding hole 21 and vent hole 14, and on the other hand, act as a buffer against the movement of sound guiding apparatus 20.

The punched hole 233 is arranged on the side wall of cover body 232, and correspondingly, the punched hole 242 is also arranged on the side wall of sealing gasket 24, and connected with punched hole 213 to form the vent hole 22 (as shown in FIG. 1) of sound guiding apparatus 20. Ring edge 234 extending along the direction away from the axis is arrange on the open end edge of cover body 232, on which several notches 235 extending radially are arranged, and matched with limit rib 133 on the internal wall surface of the second shell 13 so that limit rib 133 is used as the track for cover body 232 to move back and forth in the second shell 13. The speaker 30 is roughly cylindrical in some embodiments, and coaxially installed on the open end of cove body 232 of sound guiding apparatus 20, and moves with sound guiding apparatus 20, and its vibrating diaphragm is located at the opposite side of speaker 30 and cover body 232. Elastic element 40 is a columnar spring in some embodiments with one end connecting the end of inserting part 122 of the first shell 12, and another end connecting the open end of sound guiding component 23. It can be understood that elastic element 40 is not limited to a columnar spring, and other appropriate elastic elements are also applicable. E&M 50 is barrel-shaped, and is connected to the other end opposite to the end where cover body 232 of cylindrical shell 230 of sound guiding component 23 is located, and has an axial sound emission hole 51 connected with sound guiding component 23. Ring-type groove 52 is arranged on the circumference of external side wall surface of E&M 50, and used to engage with ear plug 60.

The above is only the description of the preferred embodiments of the present invention, and the scope of protection of the present invention includes embodiments described above and technical proposals of the present invention. It should be noted that of ordinary skill in the art, without departing from the principles of the present invention, under the premise of the several improvements and modifications should be regarded as the protection scope of the present invention.

The invention claimed is:

1. An earphone, comprising:

a shell;

a speaker arranged in said shell;

a sound chamber corresponding to said speaker;

an earpiece having a sound emission hole arranged therein and connected with said sound chamber; and a pressure relief channel having an open position connecting said sound chamber to an outside of said shell and a closed position in which said sound chamber is not connected to an outside of said shell by said pressure relief channel, wherein said pressure relief channel is switched from said closed position to said open position by the effect of friction force of an internal surface of a user's ear canal transferred to said earpiece when a user puts said earpiece in the user's ear canal.

2. The earphone according to claim 1, further comprising a sound guiding apparatus and an elastic element; said sound guiding apparatus being arranged on a side wall of said shell, and being longitudinally movable back and forth between a stretch-out position and a draw-back position on the side wall of said shell; wherein, when said sound guiding apparatus is at the stretch-out position, said pressure relief channel is in said closed position, when said sound guiding apparatus is at the draw-back position, said pressure relief channel is in said open position, and said elastic element is arranged between said sound guiding apparatus and said shell to normally keep the said sound guiding apparatus at the stretch-out position.

3. The earphone according to claim 2, wherein said speaker is arranged on the end of said sound guiding apparatus in said shell, and used to define said sound chamber together with such end; said earpiece is arranged on the other end of said sound guiding apparatus outside said shell, a sound guiding hole being arranged in said sound guiding apparatus connecting said sound emission hole with said sound chamber.

4. The earphone according to claim 3, wherein said pressure relief channel includes a first vent hole arranged on the side wall corresponding to said sound guiding apparatus and said sound chamber, and penetrated through the side wall of said sound guiding apparatus, wherein, when said sound guiding apparatus is at the stretch-out position, the external wall surface of said side wall of said sound guiding apparatus is close to the internal wall surface of said shell, and said first vent hole is blocked, and when said sound guiding apparatus is at the draw-back position, a gap is arranged between the external wall surface of said side wall of said sound guiding apparatus and the internal wall surface of said shell, and said first vent hole is connected, and connects said sound chamber and said gap.

5. The earphone according to claim 4, wherein said said pressure relief channel further comprises a second vent hole arranged on the side wall of said shell connecting said gap and the outside of said shell so as to connect said sound chamber and the outside of said shell when the said pressure relief channel is in the open position.

6. The earphone according to claim 5, wherein said shell comprises a first shell part and a second shell part spliced with the first shell part, said first shell comprising a first open end on which a ring-type inserting part inserted in the second shell is arranged, and said second shell comprising a second open end inserted on said inserting part.

7. The earphone according to claim 6, wherein at least one limit slot is axially arranged on a circumference of said inserting part; at least a limit rib extending along an axial direction is arranged on the internal wall surface of said second shell and located on said at least one limit slot of said first shell.

8. The earphone according to claim 7, wherein said second shell comprises a closed end opposite to said second open end, in which a through hole is arranged in a center of said closed end to provide a space for said sound guiding apparatus to pass through longitudinally; said sound guiding apparatus comprising a sound guiding component longitudinally passing through said through hole and a sealing gasket fixed on the periphery of said sound guiding component; said sound guiding component comprising a cylindrical shell axially passing through the said through hole and a cover body installed on one end of said cylindrical shell; said cylindrical shell defining the sound guiding hole of said sound guiding apparatus, and said cover body and speaker defining together said sound chamber.

9. The earphone according to claim 8, wherein a first punched hole is arranged at the center of said sealing gasket to provide a space for said cylindrical shell to pass through; the internal wall surface of said sealing gasket being stuck on the external wall surface of said cover body, and movable with said sound guiding component; a second punched hole is arranged on the side wall of said cover body, and a third punched hole is arranged on the side wall of said sealing gasket, and connecting with the second punched hole to form the said first vent hole of said sound guiding apparatus.

10. The earphone according to claim 9, wherein a ring edge extending outward is arranged on the open end edge of said cover body, on which at least a notch extending radially is formed, and matched with the at least one limit rib on the internal wall surface of said second shell, which is used as a track for said cover body to move back and forth in said second shell.

* * * * *